United States Patent [19]

Lacan

[11] 4,156,795

[45] May 29, 1979

[54] ELECTRIC DUCT

[75] Inventor: Guy H. Lacan, Le Mesnil le Roi, France

[73] Assignee: Technilec, Gonesse, France

[21] Appl. No.: 753,018

[22] Filed: Dec. 21, 1976

[30] Foreign Application Priority Data

Dec. 31, 1975 [FR] France ..... 75 40254

[51] Int. Cl.[2] ..... H01B 3/04; H01B 3/06; H01B 3/26

[52] U.S. Cl. ..... 174/97; 174/48; 174/84 S; 174/101; 339/22 R

[58] Field of Search ..... 174/48, 49, 68 C, 70 C, 174/84 S, 72 C, 95, 97, 101; 339/22 R, 23; 138/108

[56] References Cited

U.S. PATENT DOCUMENTS

| | | | |
|---|---|---|---|
| 739,282 | 9/1903 | Bohn | 174/101 X |
| 1,823,819 | 9/1931 | Crampton | 174/101 X |
| 1,867,430 | 7/1932 | Wisner | 174/84 S |
| 2,384,487 | 9/1945 | O'Brien | 339/22 R |
| 3,529,857 | 9/1970 | Dalton et al. | 403/263 |

FOREIGN PATENT DOCUMENTS

| | | | |
|---|---|---|---|
| 556612 | 10/1972 | Switzerland | 174/101 |

*Primary Examiner*—Laramie E. Askin

*Attorney, Agent, or Firm*—Cushman, Darby & Cushman

[57] ABSTRACT

The invention provides an electric duct for locating insulated electric wires along a wall. A removable cover member has internal channels in which wires are located at junction positions adjacent blind holes in the member through which spikes or claws of connectors extend to pierce the insulation on the wires and contact their conductive cores. The wires are retained in their channels by protuberances on a co-operating element which is locked to the cover member.

13 Claims, 11 Drawing Figures

ELECTRIC DUCT

BACKGROUND OF THE INVENTION

1. Field of the Invention

The invention relates to a duct intended to contain electric wires or signal transmission wires in a building and adapted to receive junction connectors in predetermined positions.

2. Description of the Prior Art

Numerous types of ducts for electric wires are already known, these ducts sometimes being called electric distribution troughs, or mouldings or plinths for electric wires. Whatever they are called, all known ducts generally comprise two elements: an elongated, hollow fixed element which is also called the base and which is fixed to the wall and contains the wires, together with a movable elongated element or cover which closes the base when the wires have been placed in the base and which is removed to permit access to the wires.

Inside the base the wires are separated from one another and located in grooves, either over their entire length or only over parts of their length.

The grooves do not enable wire connection means to be placed in position in the base; it has therefore been found necessary to eliminate these grooves except at certain points where it is necessary to position to the wires precisely. The precise positioning of the wires is however obligatory when use is made of connectors provided with electric contact spikes or claws. These electric contact spikes or claws pass through apertures provided in predetermined positions in the cover and penetrate into the insulating sheath of the wires so as to make direct contact with the electric conductors. When the electric ducting is installed, it is therefore necessary to achieve precise correspondence between the locations where the wires are held by guide means inside the base and the predetermined positions provided on the cover for installing and fastening these connectors.

A main object of the invention is to provide an electric duct in which the need for precise correspondence between two separate elements of the duct, which have to be assembled at the place of use, is completely eliminated.

A secondary object of the invention is to provide an electric duct of the type defined above which is simple to manufacture by mass production methods and whose installation on site requires only little labour.

SUMMARY OF THE INVENTION

According to the invention there is provided an electric duct for locating insulated electric wires along a wall, comprising a movable cover element having predetermined junction positions which are spaced apart and are provided with holes for the passage of contact spikes or claws of junction connectors for the electric wires, which movable cover element has a main wall whose inner face is formed with individual channels for holding and guiding electric wires in positions corresponding to said holes; and a co-operating element having protuberances on at least one face at least at the junction positions, which protuberances are spaced apart so as to engage in the channels in order to secure the insulated wires in position in the channels at the junction positions.

In this way all need for accurate positioning to be observed during installation, between the co-operating elements, for example the cover and the base, is eliminated.

In a preferred embodiment the co-operating element is an intermediate element adapted to be located beween the movable cover element and the base element.

The invention permits many constructional variants because the intermediate element may be detachably connected to the movable element, or may be joined to the movable element by means of a flexible hinge, or may be placed inside the fixed element, or be integral with the fixed element.

For the installation of connectors the cover element is generally provided with blind holes grouped together at connection positions spaced apart in the longitudinal direction.

In a preferred embodiment of the invention the individual channels are limited on the inner face of the movable cover element to portions situated only at each of the junction positions. In this way it is also possible to limit either the intermediate element or the protuberances only of that element to lengths corresponding to each of the connecton spikes.

The movable cover element is provided with means by which it is held in its final position. These means are known per se and they are appropriate to the nature of the co-operating element which may be a fixed element.

When the duct is fixed to a wall face or into a groove made in a wall, the movable cover element may have longitudinal edgings adapted to be applied against the wall and to be fixed to the wall by adhesive bonding or by nailing.

When the co-operating element, which may be a fixed element, is a hollow section, the movable element and this hollow section are provided with complementary clipping means which can easily be engaged or disengaged from one another.

BRIEF DESCRIPTION OF THE DRAWINGS

In order that the invention may be more clearly understood some embodiments thereof will now be described, by way of example, with reference to the accompanying drawings in which.

DESCRIPTION OF THE PREFERRED EMBODIMENTS

Figure 1:
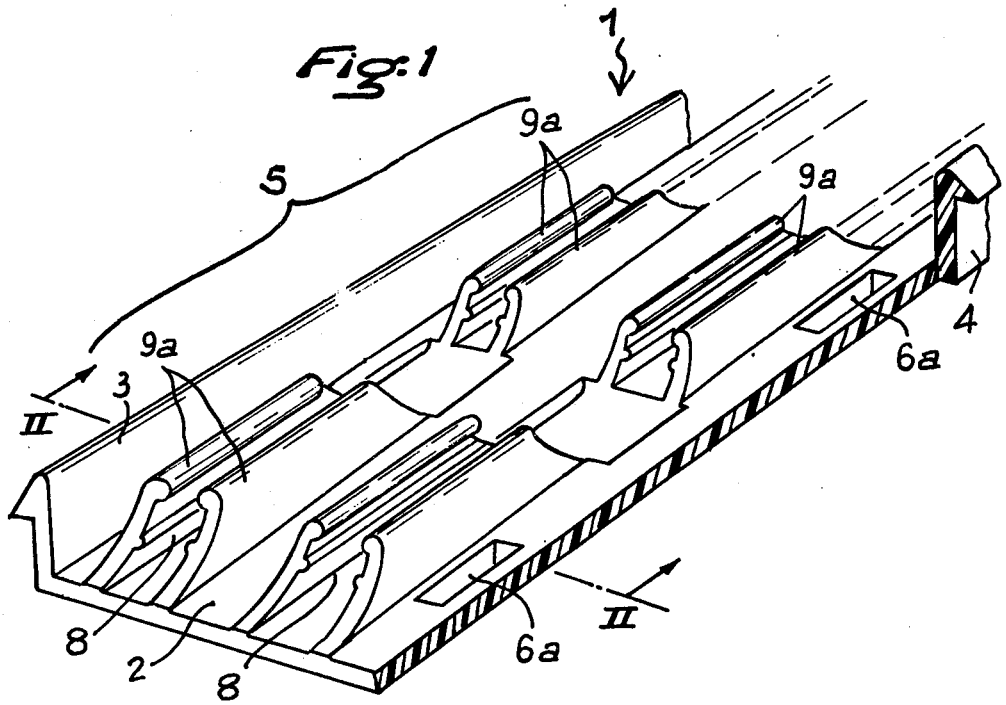
FIG. 1 is a perspective view of a first embodiment of a movable element forming part of an electric duct according to the invention.
Figure 2:
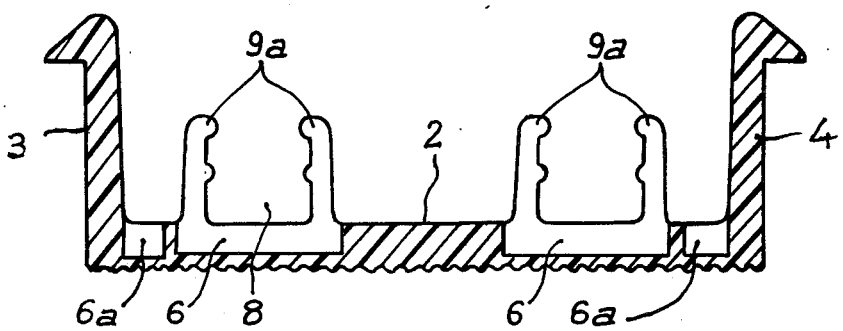
FIG. 2 is a view in cross-section on the line II—II of FIG. 1.
Figures 3, 4, 5:
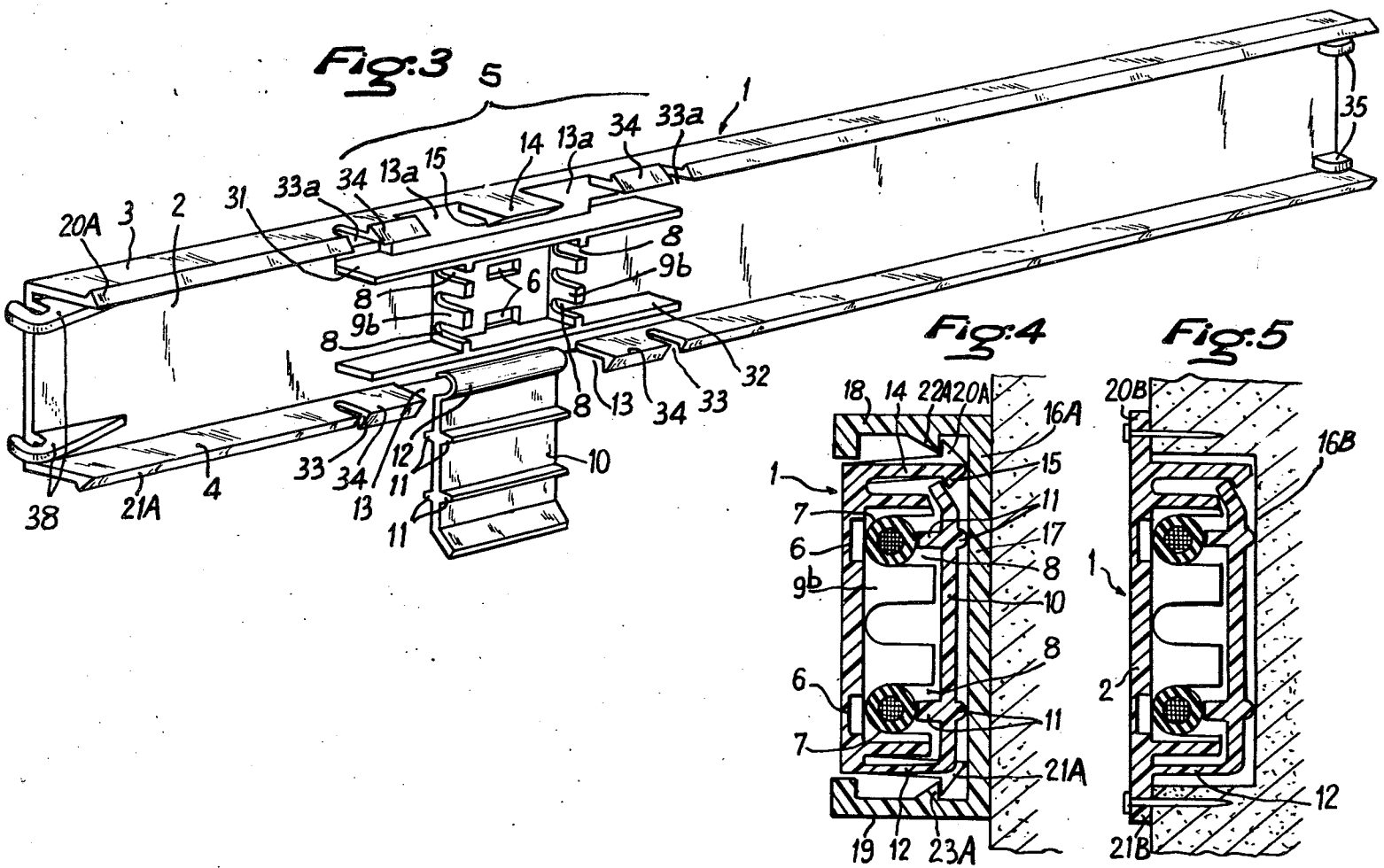
FIG. 3 is a perspective view of a second embodiment of the movable element forming part of an electric duct according to the invention, and also shows a form of construction of an intermediate element which forms part of an electric duct according to the invention.
FIGS. 4, 5 and 6 are respectively views in cross-section showing the movable and intermediate elements of a duct according to the invention, which are suitable for use together with a fixed element comprising respectively a hollow section (FIG. 4), a groove formed in a wall (FIG. 5), and a flat wall face (FIG. 6)

Referring to FIGS. 1 to 3, a movable element 1 or cover of a duct according to the invention will first be described. This element 1 has constant characteristics whatever the intermediate element or fixed element used; and it has other characteristics which can be adapted to match the particular intermediate element or fixed element.

The movable element 1 is composed of successive portions each of about two meters long. Each portion has a main wall 2 from which there extend two side walls 3 and 4 which are spaced apart. The existence of the side walls 3 and 4 is not essential as will be explained. The main wall 2 has positions 5 which are spaced apart in the longitudinal direction of the element 1 and are provided for the installation of electric junction connectors. In FIG. 1 a part of the side wall 4 has been cut away so that the position 5 can be seen more clearly.

A movable element portion two meters long of the kind shown in FIG. 1 may have one or more junction positions 5. However, in a very long electric duct some of the movable element portions may have no positions 5 for connectors. The important characteristic is that in an electric duct according to the invention there are positions 5 which are spaced apart and which are provided in the movable element 1, as will now be described.

At each position 5 blind holes are provided in the main wall 2, certain of which holes 6*a* serve for the fastening of a connector on the element 1, while other holes 6 serve for the passage of spikes or claws forming part of the connector; which spikes or claws contact the conductor core of the electric wires by passing through the insulating layer on the wires.

At each position 5 individual channels 8 form part of the movable element or cover 1 of the duct. The channels 8 may be formed in various ways.

In FIGS. 1 and 2 longitudinal ribs 9*a* extend from the main wall 2, on each side of the blind holes 6. These ribs 9*a* have a profile and an inner face which are so shaped that an insulated electric wire can easily be introduced and secured in the channel 8 formed between two ribs 9*a* and facing a row of blind holes 6.

In FIG. 3 the channels 8 are defined by notches formed in two cross-partitions 9*b* which are spaced apart and are situated on each side of each position 5.

The channels 8 may extend along the entire length of the element 1. In the preferred embodiment which is described it is more advantageous for the channels 8 to be limited to the positions 5, because if is then possible for the electric wires to be crossed over from one channel to another between these positions.

The difference between the embodiment of FIGS. 1 and 2 and that of FIG. 3 is as follows.

The movable element 1 of FIGS. 1 and 2 may be made of plastic material either by extrusion, with continuous longitudinal ribs 9*a* which are then cut away outside the positions 5, or by moulding with discontinuous ribs 9*a* produced directly.

The element 1 of FIG. 3 can be produced by injection moulding of the one of the following plastic materials: vinyl chloride, acrylonitrile-butadiene-styrene, polypropylene, nylon, or an equivalent material.

Now that the main characteristic of the movable element 1 of an electric duct according to the invention has been described, a description will be given of the intermediate element.

The grooves 8 are designed to hold the insulated wires which are introduced into them, but this holding action could not withstand the force of penetration of the contact spikes or claws which pass through the insulating material in order to make the connection between the connector and the electric conductor. The intermediate element of the invention is unknown in conventional ducts. Its purpose is to secure the electric wires in the grooves 8 of the movable element or cover 1 of the duct.

In its broadest aspect the intermediate element 10 is generally flat and it is provided with protuberances 11 on at least one of its main faces. These protuberances 11 are spaced the same distance apart as the channels 8 and they penetrate into the channels 8 in order to secure the electric wires in the bottoms of these channels 8.

In FIG. 3 the element 10 is connected to the element 1 by a flexible hinge 12 consisting of a part of the side wall 4 which is of reduced thickness and is separated by gaps 13 from the remainder of the wall. When the element 10 is as shown in FIG. 3, the two elements 1 and 10 may be moulded in a single piece.

In the side wall 3 opposite the hinge 12 a corresponding portion 14 separated by gaps 13*a* from the remainder of the side wall 3 has at its free end a fastening clip 15. Thus, when the element 10 is moved from the position shown in FIG. 3 to the position shown in FIG. 4 this element 10 is held by the fastening clip 15 in the position in which it closes the channels 8 and secures the wires 7 in the channels.

The element 10 is preferably provided with protuberances 11 on both its main faces, for securing the electric wires in the channels 8 when the element 10 bears against the inner face of a fixed element which will be described.

The flexible hinge 12 may be attached to a part of the element 1 other than a side wall. Also the intermediate element 10 may be made in the form of independent portions which are located at each position 5 by clipping to the element 1 over the grooves 8. For example the ribs 9*a* may act to clip the element 10 in position.

After the electric wires have been introduced into the channels 8, the wires are secured in the channels by placing the elements 10 in position at each position 5, to produce a complete assembly comprising the cover and the wires. This is clearly distinguished from conventional electric ducts in which the electric wires are first placed in the base and not in the cover.

The arrangement of the positions 5 in the movable element or cover 1 and of the wires 7 held in the grooves 8 by the element 10 provides an important advantage. Accurate positional correspondence of the holes 6 and wires 7 is always achieved automatically without any precautions being taken during installation. This correspondence is much more difficult to achieve when the holes are provided in the cover and the wires are accommodated and retained in the base of the duct, as has been customary up to the present time.

The elements 1 and 10 are adapted to suit the nature of the element to which they are fixed which is given the reference 16A or 16B. In FIG. 4 this element 16A is a hollow channel section which may be produced by extrusion of plastic material or of light metal. It has a bottom wall 17 by which it may be fixed against a wall, and two side walls 18 and 19.

The free edges of the side walls 3 and 4 of the movable element 1 are provided with external fastening means 20A and 21A, and the side walls 18 and 19 of the base element 16A are provided internally with complementary clipping means 22A and 23A. Because of the natural elasticity of the material of which the element 1 is made, the movable element 1 can be easily introduced into the base element 16A and be clipped internally in the base element. The cover 1 can still be removed if so desired.

Figure 8:
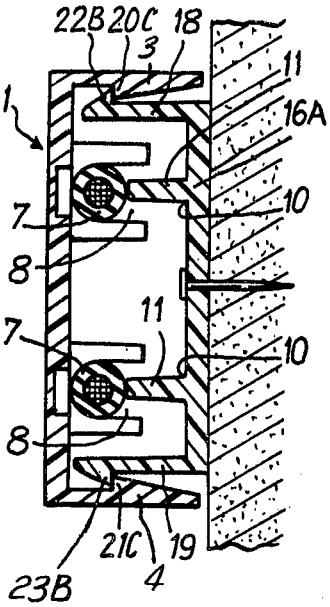
FIG. 8 is a view in cross-section in which the intermediate element and fixed element are integral, and the movable element is a modification of the movable element of FIG. 4.

As shown in FIG. 8 it is possible for the relative arrangement of the elements 16A and 1 to be transposed, and to arrange for the side walls 3 and 4 of the movable cover element 1 to contain and cover the side walls 18 and 19 of the element 16A which also carries the protuberances 11. The fastening means 20C and 21C are then disposed internally, while the clipping means 22B and 23B are disposed externally in relation to the walls.

In FIG. 5 the fixed element 16B is a groove in a wall. In this case the movable element 1 partly penetrates into the groove and it closes the groove like a cover. For this purpose the side walls 3 and 4 of the element 1 are provided with external fastening means 20B, 21B which constitute two longitudinal bands situated substantially in line with the main wall 2. These longitudinal bands 20B, 21B are applied against the wall of the building and serve for fastening the element 10.

Figure 6:
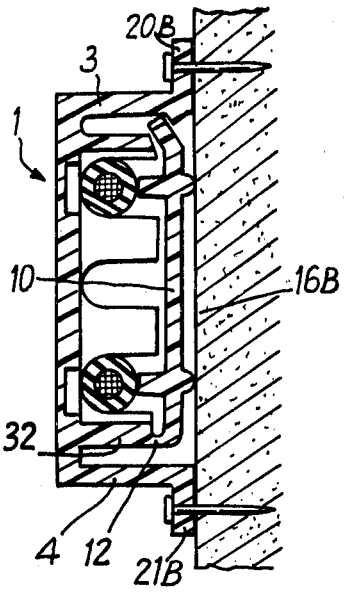

In FIG. 6 the fixed element 16B is a wall face. In this case the external fastening means 20B, 21B of the element 1 consist of two longitudinal edgings which extend from the side walls 3 and 4; these edgings are attached to the wall surface to fasten the cover 1 to the wall.

Figure 7:
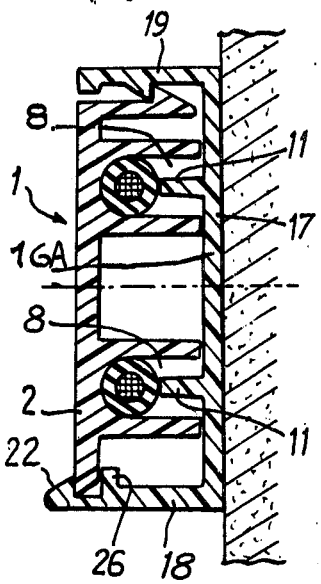
FIG. 7 is a view in cross-section of a duct according to the invention in which the intermediate element and the fixed element are integral, two different forms of construction of the fixed element being shown at the top and bottom of the Figure respectively.

In FIG. 7 the fixed element 16A serving as base is an extruded section having a bottom wall 17 and two side walls 18, 19. At the top and bottom of a central line shown as a dot-dash line, two different embodiments of these side walls are shown. In the upper part of the Figure the side wall 19 is similar to the walls 18 and 19 in FIG. 4. In the lower part of the Figure the wall 18 is provided with a clipping means 22 which is situated at the free end of that wall. A longitudinal rib 26 extends parallel to the clipping means 22, at a distance corresponding to the thickness of the movable element or cover 1 which has no side walls. Rather the free edge of the main wall 2 of the element 1 is bevelled so as to be able to pass the clipping means 22 and to be stopped by the rib 26 which acts as a stop.

In the embodiment shown in FIG. 7 the intermediate element 10 is integral with the fixed element or base 16A. More precisely, the element 10 forms part of the bottom wall 17 and the protuberances 11 extend directly from the wall 17 into the channels 8 in the cover 1.

Figure 9:
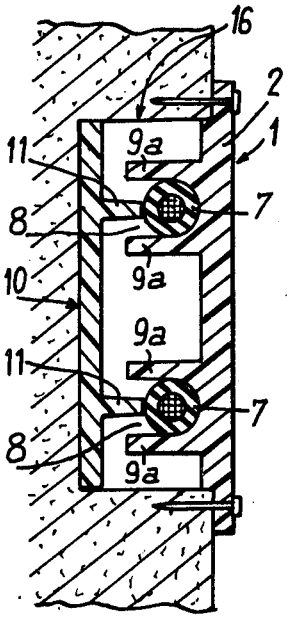
FIG. 9 is a view in cross-section of an electric duct in which the three elements are separate from one another, the fixed element being a groove made in a wall.

FIG. 9 illustrates an embodiment in which the movable element 1 is reduced to the main wall 2 with ribs **9*a* which define the channels 8 containing the insulated wires 7. The fixed element or base 16 is a groove formed in a wall of the building. The intermediate element 10 is a strip which is accommodated in the bottom of the groove 16 and carries, at least at the positions 5 for the installation of connectors, protuberances 11 directed into the channels 8**.

The various embodiments which have been described clearly show characteristics which may be summarized as follows:

(a) the movable element corresponding to the cover of a conventional duct is provided on its inner face with channels 8 intended to hold the wires 7 opposite openings 6 for the passage of the connection spikes or claws of the connectors;

(b) the fixed element, corresponding to the base of a conventional duct, has no groove or channel such as is usually intended to receive the electric wires; consequently this element may take various forms such as a section fixed to a wall, a groove formed in a wall, or a wall face;

(c) an intermediate element 10, which has no equivalent in conventional ducts, may be placed between what would be the cover and the base in a conventional duct and is provided with protuberances 11 which secure the insulated wires 7 at the bottom of the channels 8. This intermediate element 10 may be an independent part placed between the elements 1 and 16 or it may be incorporated in one or the other of these two elements 1 and 16.

In FIG. 3 it can also be seen that in the region of the position 5 reinforcement has been provided for the fastening means 20A and 21A so that the movable element 1 will better withstand the tractive forces which may be applied to the connector installed at the junction position 5, when the element 1 is inserted into a base of the kind shown in FIGS. 2, 4, 7 and 8.

For this purpose, beyond the gaps 13 and **13*a*, notches 33 and 33*a* define flexible tongues 34 in the walls 3 and 4. These tongues are provided on their end edges with fastening means more effective than those of the side walls 3, 4 beyond the position 5**.

Figure 10:
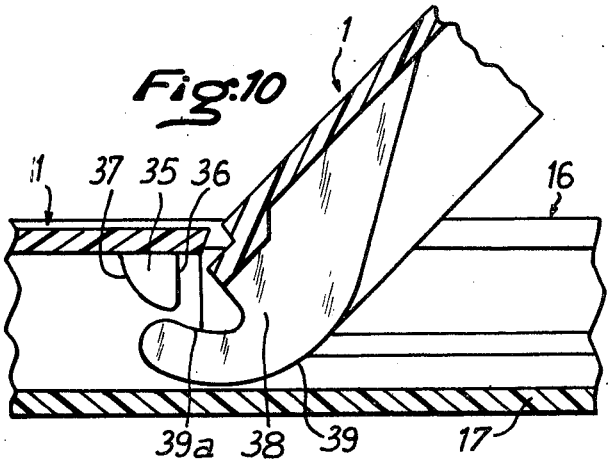
FIGS. 10 and 11 are detail views on a larger scale, showing means of butt connection of successive movable element portions of the duct.
Figure 11:
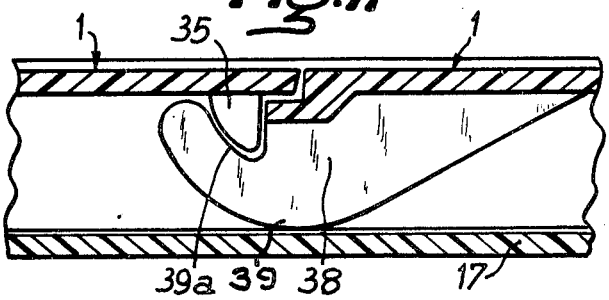

An electric duct consists of a plurality of movable elements or covers 1 and it is possible for these covers to follow one another closely and to be joined together with the best possible continuity. For this purpose complementary clipping means are provided at the two opposite ends of each movable element 1. For example, as shown in FIGS. 10 and 11, at one end there are provided two internal bosses 35 spaced apart transversely each having a flat end face 36 perpendicular to the wall 2, and a sharply incurved inner face 37. At the opposite end there are provided two hooks 38 projecting outwardly and having a sharply rounded back 39 and designed to come into contact with the inner face of the bottom wall 17 of the fixed element 16. The internal curvature **39*a* of each hook 38 corresponds to the incurving of the inner face 37 of the bosses 35**.

In order to place a movable element portion 1 in position in a base element 16, to follow a first movable element portion 1 already joined to the base element 16, the procedure is as shown in FIGS. 10 and 11. The end of the element 1 provided with hooks 38 is introduced obliquely into the fixed element 16 until the hooks go beyond the bosses 35. A pivoting movement is then made in the direction of the fixed element, in the course of which the hooks 38 engage behind the bosses 35 and close over them. At the same time the rounded back 39 of the hooks 38 contacts the bottom wall 17 of the fixed element. Accurate positioning in line of the outer faces of the movable element portions 1 is thus obtained.

When the side walls 3 and 4 of the movable elements 1 remain visible over their entire length, as in the embodiment of FIG. 6, the gaps 13 and 13*a*, FIG. 3, provided in the side walls 4 and 3 are eliminated. In the same FIG. 3 it can be seen that at the position 5 the side walls 3 and 4 are respectively lined with longitudinal internal partitions 31 and 32. The cross-partitions 9*b* extend between the partitions 31 and 32 which reinforce the protection of the zone where the spikes or claws of a connector passing through the holes 6 come into contact with the current conducting cores of the wires 7.

When the walls 3 and 4 are continuous, the longitudinal partition 32 may serve as a connection, by means of a flexible hinge 12, between the intermediate element 10 and the movable element 1, as shown in FIG. 6.

What is claimed:

1. An electric duct for locating insulated electric wires along a wall, comprising a movable cover element having predetermined junction positions which are spaced apart and are provided with holes for the passage of contact spikes or claws of junction connectors for the electric wires, which movable cover element has a main wall whose inner face is formed with individual channels for guiding and holding electric wires in positions in which said electric wires pass in front of said holes; and a cooperating element have protuberances on at least one face at the junction positions, which protuberances are spaced apart so as to engage in the channels in order to secure firmly the insulated wires in position into the channels at the junction positions.

2. An electric duct according to claim 1, including a base element adapted to bear against a wall, and wherein the co-operating element is an intermediate element adapted to be located between the movable cover element and the base element.

3. An electric duct according to claim 2, wherein the base element is a hollow section having a bottom wall and two side walls, the free ends of which side walls are formed with fastening means, and the movable cover element has on its opposite sides, in the transverse direction, fastening means complementary to the fastening means on the base element.

4. An electric duct according to claim 1, comprising a flexible hinge joining the co-operating element to the movable cover element, and, on a free end of said co-operating element, means for attaching said co-operating element to the movable cover element when the co-operating element is closed over the channels.

5. An electric duct according to claim 1, wherein the co-operating element is an independent element having at two opposite ends means for clipping the co-operating element to the movable cover element when the co-operating element is placed transversely on the cover element and covers the channels.

6. An electric duct according to claim 1, wherein the co-operating element is an independent part adapted to be located in the bottom of a groove in a wall.

7. An electric duct according to claim 1, wherein the co-operating element is a hollow section having a bottom wall from which the protuberances project and side walls which are joined by fastening means to complementary fastening means on the side walls of the movable cover element.

8. An electric duct according to claim 1, wherein the free ends of the side walls of the cover element are provided with means for fastening the cover element to a wall.

9. An electric duct according to claim 1, wherein the channels are defined at each junction position by notches provided in two transverse partitions which are spaced apart longitudinally of the duct and are situated one on each side of the junction position.

10. An electric duct according to claim 9, wherein at each junction position the side walls of the movable cover element are each lined by an internal longitudinal partition and the transverse partitions extend between the longitudinal partitions.

11. An electric duct according to claim 1, wherein the channels are defined by pairs of parallel longitudinal ribs of which the ribs of each pair extend one on each side of the connection holes at least at each junction position.

12. An electric duct according to claim 1, wherein the movable cover element is made up of successive portions and the opposite ends of each portion are provided with complementary attachment means.

13. An electric duct according to claim 12, wherein at one end the attachment means consists of two bosses spaced apart transversely and having an incurved inner face, and at the other end the attachment means consists of two hooks spaced apart transversely and each having an internal curvature which corresponds to the incurving of the inner face of the bosses and a rounded back adapted to contact the inner face of the fixed element.

* * * * *